United States Patent [19]

Carlson et al.

[11] Patent Number: 4,708,315

[45] Date of Patent: Nov. 24, 1987

[54] MULTIPLE PURPOSE CONCRETE FORM WITH SIDE RAIL STIFFENERS

[75] Inventors: Michael G. Carlson, Lenexa; Ronald A. Ward, Overland Park, both of Kans.; Terry H. Jolin, Lee Summit, Mo.

[73] Assignee: Western Forms, Inc., Kansas City, Mo.

[21] Appl. No.: 880,038

[22] Filed: Jun. 30, 1986

Related U.S. Application Data

[63] Continuation-in-part of Ser. No. 862,249, May 12, 1986.

[51] Int. Cl.[4] ..... E04G 11/10

[52] U.S. Cl. ..... 249/192; 249/45; 249/49; 249/191; 249/194; 249/210; 249/219 R

[58] Field of Search ..... 249/207, 210, 219 R, 249/189, 191, 192, 193, 196, 33, 44, 47, 48, 10, 45, 49, 194

[56] References Cited

U.S. PATENT DOCUMENTS

| | | | |
|---|---|---|---|
| 349,320 | 9/1886 | Rosenblatt | 249/166 |
| 759,031 | 5/1904 | Shumway | 249/16 |
| 1,245,477 | 11/1917 | Loxterman | 249/184 |
| 1,300,435 | 4/1919 | McKay | 249/27 |
| 1,468,316 | 9/1923 | Mead | 249/50 |
| 1,694,292 | 12/1928 | Tracey | 249/27 |
| 1,808,912 | 6/1931 | Willard | 249/42 |
| 1,871,919 | 8/1932 | Schubert | 249/48 |
| 1,875,136 | 8/1932 | Podd | 249/46 |
| 1,912,356 | 6/1933 | Beghetti | 249/46 |
| 2,005,301 | 6/1935 | Rafter | 52/591 |
| 2,140,772 | 12/1938 | Slayter et al. | 52/580 |
| 2,222,339 | 11/1940 | Schenk | 249/214 |
| 2,236,616 | 4/1941 | Bosco | 249/45 |
| 2,250,064 | 7/1941 | Jorsch | 249/34 |
| 2,296,036 | 9/1942 | Horn | 249/190 |
| 2,297,899 | 10/1942 | Krueger | 249/45 |
| 2,336,253 | 12/1943 | Jennings | 249/190 |
| 2,447,670 | 8/1948 | Rumble | 249/189 |
| 2,641,043 | 6/1953 | Martin | 249/192 |
| 2,761,191 | 9/1956 | Anderson | 228/155 |
| 2,816,345 | 12/1957 | Symons | 249/191 |
| 2,917,803 | 12/1959 | Phillips | 249/6 |
| 2,963,763 | 12/1960 | Le Cluyse | 249/190 |
| 3,167,842 | 2/1965 | Pauli, Jr. | 249/46 |
| 3,447,771 | 6/1969 | Trimmer | 249/192 |
| 3,696,177 | 10/1972 | Holland | 264/32 |
| 3,734,451 | 5/1973 | Tierney | 249/192 |
| 3,899,155 | 8/1975 | Ward | 249/189 |
| 3,926,400 | 12/1975 | Franc | 249/40 |
| 4,068,818 | 1/1978 | Gates | 249/42 |
| 4,147,322 | 4/1979 | Dahlstrom | 249/40 |
| 4,192,481 | 3/1980 | Durbin | 249/42 |
| 4,231,541 | 11/1980 | Strickland | 249/216 |
| 4,254,932 | 3/1981 | Durbin | 249/42 |
| 4,397,441 | 8/1983 | Manderla | 249/19 |

FOREIGN PATENT DOCUMENTS 853278 11/1960 United Kingdom .

OTHER PUBLICATIONS

Brochure, one page–Reynolds Aluminum Extruded Shapes, Rod, Bar–Dated Mar. 15, 1955.

Brochure–Symons Wall Form Construction, The Corner.

Brochure–Western Forms, A New Generation in Aluminum Forming Systems.

Brochure pages–Rocform Systems, dated 2/17/69 and Nov. 85.

Notebook–Concrete Form Manufacturers Index.

*Primary Examiner*—Jay H. Woo

*Assistant Examiner*—James C. Housel

*Attorney, Agent, or Firm*—W. Bruce Day

[57] ABSTRACT

Multipurpose concrete form panels are constructed using cross stiffener members for resistance to deflection under load. Each of the cross stiffener members is formed of a base strip of metal with a pair of parallel ribs of hat section extending therefrom and joined to opposite side rails of the form panel. Rail stiffener strips are fastened to the side rails on alternate sides of the rail for added rigidity. Bores for connecting pins extend through the side rails to join the panels side by side to form a wall or, using a corner form, to form a column. Bores through the side rails are positioned between the cross stiffener members and between the ribs in each pair of ribs for joining the side rails together with continuity of the cross stiffener members for maximum dispersal of stress. Holes for wall ties extend through the face of the form panel and between the ribs in each pair of ribs. Fasteners for the ends of the wall ties engage the pairs of ribs to disperse localized stress.

6 Claims, 9 Drawing Figures

Fig. 2.
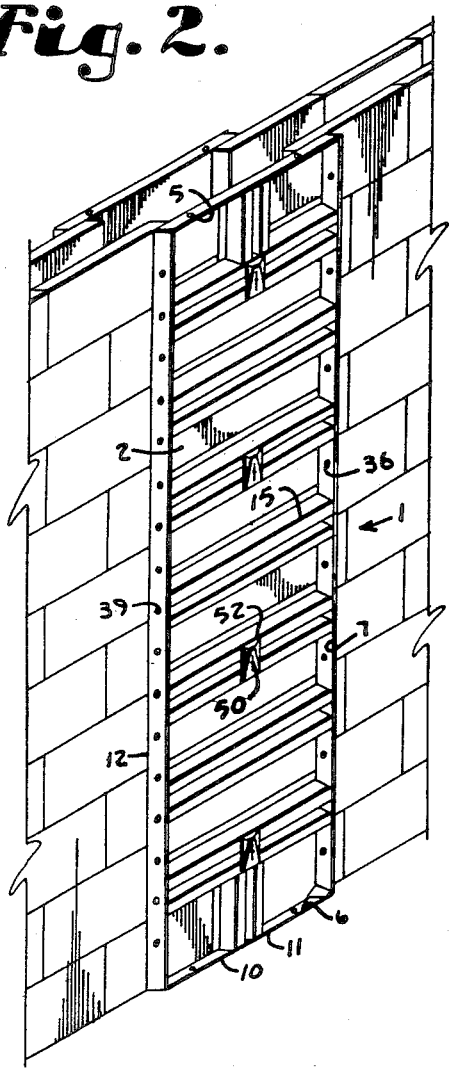
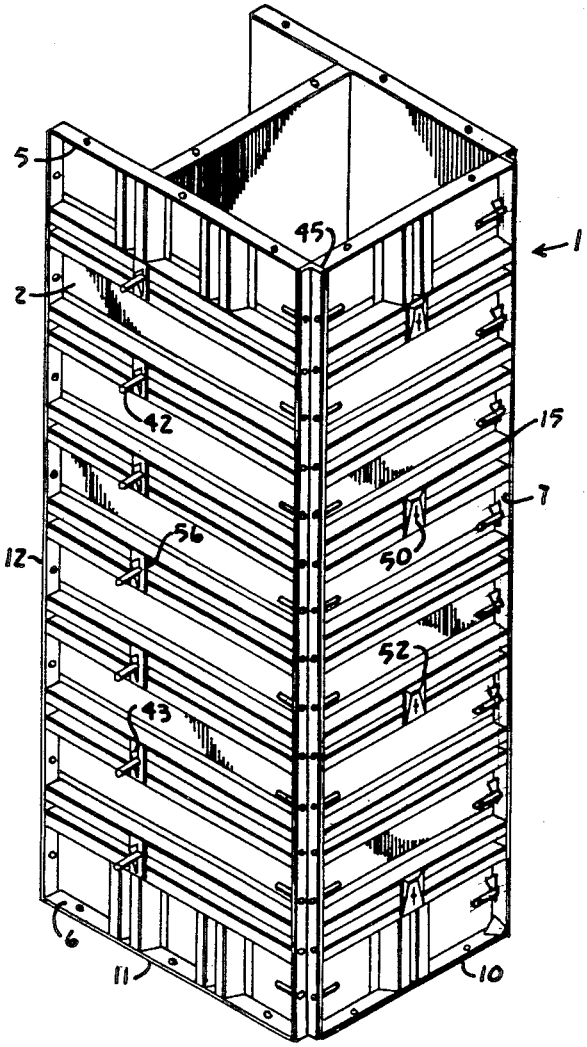
Fig. 3.
Fig. 5.
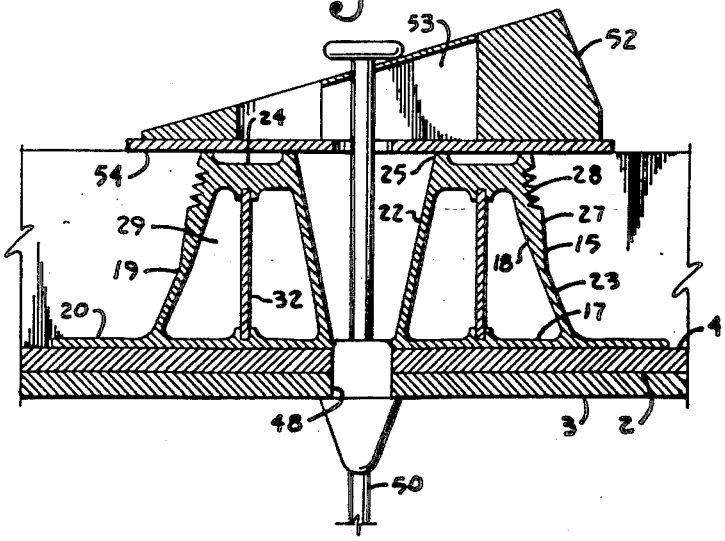

Fig. 8.
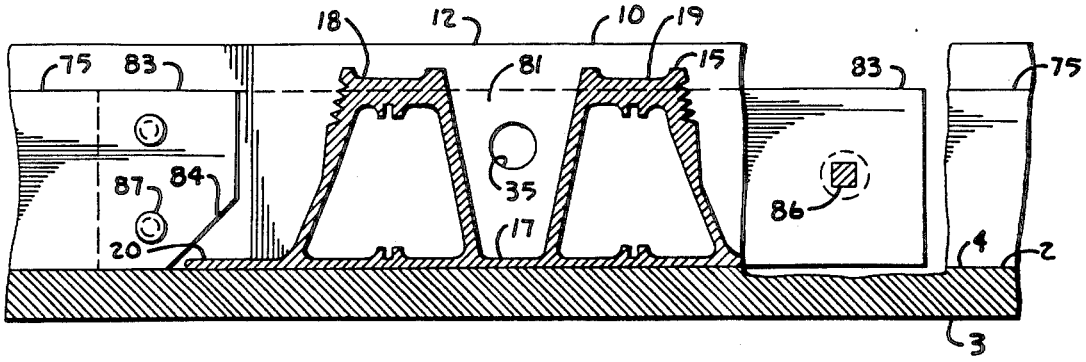
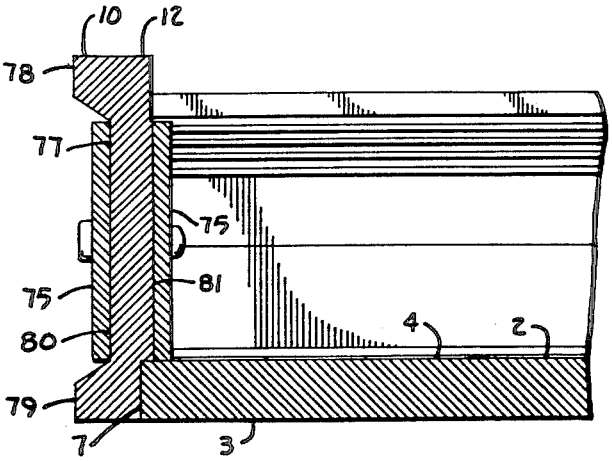
Fig. 9.

MULTIPLE PURPOSE CONCRETE FORM WITH SIDE RAIL STIFFENERS

RELATED APPLICATION

The present application is a continuation-in-part of application Ser. No. 862,249, co-pending herewith and filed May 12, 1986.

FIELD OF THE INVENTION

This invention relates to concrete form panels and particularly to such form panels which can be used for a multitude of purposes and are resistant to deflection under load.

BACKGROUND OF THE INVENTION

In the forming of concrete foundations, concrete walls and columns, an assemblage of panels are connected together in various orientations. The panels are usually three to four feet wide and eight feet high or other suitable dimensions as required by the particular application. Although some contractors still use wooden forms, the more progressive ones use form panels of aluminum or other lightweight metal, whereby the weight is such that a single workman may lift a panel without the assistance of a crane and carry the panel into place to form a wall or to remove it from the green concrete wall after pouring.

Form panels are generally used by the contractor for three types of operations: wall forming, free standing column forming, and in-fill column forming. The wall forming operation is typical foundation or concrete wall work, the free standing column is the type ordinarily employed in reinforced concrete multi-story buildings and the in-fill column is often encountered in combination column and concrete or cinder block wall construction, wherein reinforced concrete columns are interspersed along a concrete block wall at intervals for structural integrity and resistance of the structure to catastrophic failure, as in earthquake prone areas. Typically, a form manufacturer, such as the assignee herein, has had to offer three types of forms to the contractor for each of the above three types of applications, because each form has generally not been adaptable to multipurpose use.

The present invention comprises a form panel intended for multipurpose use, which may be employed in all three applications. The present form offers a significant improvement over its predecessor, the form panel which is described in U.S. Pat. No. 3,899,155, commonly owned with the present application. The prior form panel was constructed of a frame of side rails and top and bottom rails of extruded angle form aluminum alloy arranged about a face sheet of either aluminum alloy or plywood, depending upon the particular needs of the contractor.

A particular problem in the art has been to construct a form which sufficiently resists deflection upon substantial loading or, in the worst case, to prevent blow out or rupture of the forms between adjacent side rails. The goal of both the manufacturer and the contractor is to produce what is termed an L/360 surface, or a smooth, straight, deflection free surface for the finished concrete wall or column. Excessive deflection of the forms under load produces unacceptable results. The problem was particularly apparent in forming columns wherein the weight of the overlying concrete in the column produced tremendous spreading force at the bottom of the forms.

To resist against deflection or catastrophic failure, the concrete form panels disclosed in U.S. Pat. No. 3,899,155, featured cross stiffener members formed of extruded aluminum in a hat section, wherein the hat section extrusions were welded at opposite ends to the side rails and riveted along their length to the face sheet. This form produces highly acceptable results, but such forms were not felt to offer sufficient rigidity when used in column forming operations and were not usable for making in-fill columns.

The present invention is particularly designed as a multipurpose form panel and offers substantial and surprising resistance to deflection upon loading by providing a double hat section as a cross stiffener member and with side rail connector areas coincident with the double hat section ribs. Side rail stiffener strips are fastened to the side rails on alternate surfaces of the side rails for added rigidity. Further, provision is made for wall ties to extend through the face of the form and thereby connect parallel, spaced form panels together at locations in addition to normal wall tie placement areas at the side rails. Particular fastening means for either pins connecting panels together orthogonally or wall ties connecting panels together in parallel relationship are disclosed and which are designed to effectively distribute the localized stress occurring in the connection area to the cross stiffener members and thereby more effectively distribute areas of stress throughout the entire form than was previously done. The effect of such a structure is to provide a multipurpose form panel which is substantially more resistant to deflection than prior form panels and which can be used for the three main areas of form use without particular adaption to each use.

All of these features are possible in a form panel which is of greater rigidity that the previous form panels manufactured under the '155 patent and, yet, may be lighter in weight. Specifically, the face sheet may be reduced in thickness, yet the form provides greater resistance to deflection.

OBJECTS OF THE INVENTION

The principal objects of the present invention are: to provide a concrete form panel which is resistant to warpage and deflection upon loading; to provide a concrete form panel which is light in weight, yet retains the strength of a much heavier panel; to provide such a concrete form panel having cross stiffener members aligned with side rails to form connection areas, so as to evenly distribute stress at the connections over broad areas of the form panel; to provide such a concrete form panel with wall tie connection areas through the face of the form and through which the wall tie connections combine with the cross stiffener members to evenly disperse stress over the form panel; to provide such a concrete form panel with reinforced areas to distribute localized stress at connecting points; to provide a concrete form panel with cross members having broad areas of connection to side rails; to provide a concrete form panel having hollow cross members to which or in combination with which are fitted various stiffeners for added resistance to deflection; to provide such a form panel with side rails of extraordinary rigidity for resistance to deflection; and to provide such a form panel which is economical to manufacture, easily and conveniently handled and that can be quickly erected for pouring concrete.

Other objects and advantages of this invention will become apparent from the following description taken into connection with the accompanied drawings wherein are set forth, by way of illustration and example, certain embodiments of this invention.

DESCRIPTION OF THE DRAWINGS

FIG. 2 is a perspective view of the multipurpose concrete form panels arranged to construct an in-fill column.

FIG. 3 is a perspective view of the multipurpose concrete form panels arranged to provide a free standing column.

FIG. 5 is an enlarged sectional view showing a connection between the form cross stiffener members and a wall tie.

FIG. 8 is an enlarged, fragmentary view of an alternative section of the form side rails and shows rail stiffener strips.

FIG. 9 is a cross-sectional view taken along lines 9—9, FIG. 8.

DESCRIPTION OF THE PREFERRED AND ALTERNATE EMBODIMENTS

Figure 1:
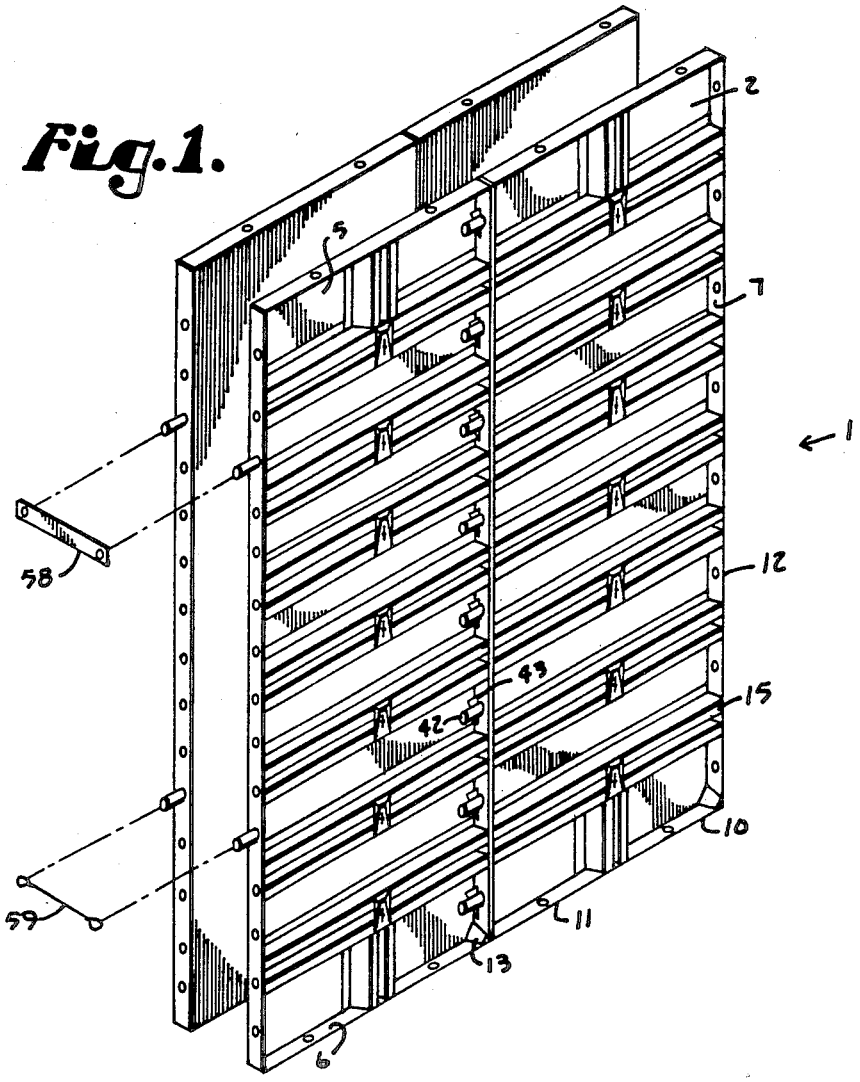
FIG. 1 is a perspective view of a multipurpose concrete form panel embodying the present invention and shown in connection with other such panels in a side by side, parallel relationship to form a wall therebetween.

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference 1, FIGS. 1, 2 and 3, generally indicates a multipurpose concrete form panel embodying the present invention. Each form panel 1 includes a face sheet 2 which may be of virtually any sufficiently sturdy planar material and is preferably of either aluminum alloy sheet stock or plywood, depending upon the particular needs of the contractor. Some contractors prefer the plywood face for nailing forms thereto, such as plumbing or electrical runs and forms for junction boxes. The face sheet 2 has front and back surfaces 3 and 4, FIGS. 4 and 5, top and bottom end edges 5 and 6, and spaced side edges 7.

Preferably, the face sheet is formed in a handy, easy to hand manuever size, such as three by eight feet or four by eight feet. A rectangular frame work 10 is positioned about the periphery of the face sheet 2 and includes top and bottom end rails 11 and side rails 12, such as formed of aluminum alloy angle extrusions, riveted, welded or otherwise affixed to the face sheet 2, depending upon the material of the face sheet, and which extend outwardly of the back surface 4. Corner gussets 13 enhance joint strength and resistance to damage during handling.

Figure 4:
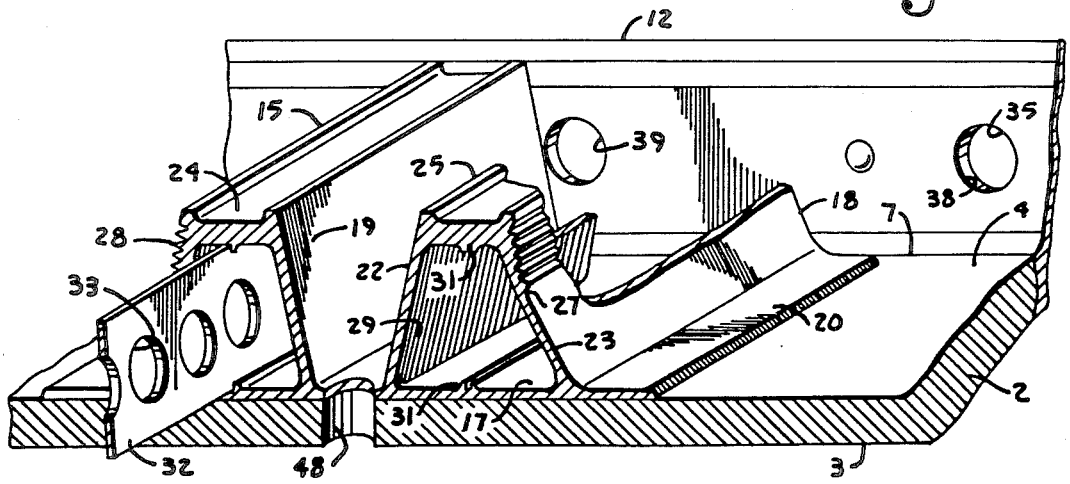
FIG. 4 is an enlarged, perspective, fragmentary view of cross stiffener members of the form panel connected to side rails.

A plurality of cross members 15 are secured to the face sheet 2 and extend between the side rails 12 for providing rigidity for the form panel 1 and resistance to deflection or warping. Each of the cross members 15, FIGS. 4 and 5, is preferably formed of a single or unitary extrusion of aluminum alloy material and includes a connecting web in the form of a base strip 17 and a pair of ribs 18 and 19 such as of hat section thereon. Each rib has a spaced base on the base strip 17 and is set from the margin of the base strip 17 to form flanges 20 for connection of the cross member 15 to the face sheet 2. Preferably, though not necessarily, the connecting web base strip 17 is located at the bottom of the hat section, though it may be placed higher and not necessarily in contact with the face sheet 2. Each rib 18 and 19 is preferably hollow and has outwardly converging legs 22 and 23 joining an upper or outer top strip 24 and projecting there above a slight distance so that the top strip 24 is indented in the top of the rib 18 or 19 by leg strips 25. The leg 22 is preferably straight and the leg 23 has a thickened portion 27 including a series of vee's 28 for additional stiffness. The legs 22 and 23 join the side rails 12 at the same height as the side rails 12 for presenting a rear surface of the form which is all of the same height or distance from the face sheet 2. This enables connection of various separate longitudinal braces, known in the art as walers, on the form. The indented top strip 24, between the leg strips 25 abuts the side rail 12 and is welded there. In production, the weld line extends all across the top strip 24 and the leg strips 25 and the weld material on top of the leg strips 25 is ground away to produce a flat leg/side rail connection with strength maintained by the weld along the indented top strip 24.

For additional stiffness of the cross member 15, means for inserting an internal stiffener, or web member, in the hollow interior 29 is provided. In the illustrated example, FIGS. 4 and 5, ways or grooves 31 are formed in the portion of the base strip 17 and top strip 24 within the hollow interior 29 and an elongate web stiffener 32 is inserted into the interior 29 along the grooves 31. Preferably, the web stiffener 32 is of a dissimilar and less expensive material than the aluminum alloy of the cross member 15 and may be strip steel from a coil thereof, such as used in the manufacture of flat concrete form ties. The steel strip may be provided with lightening holes 33 for weight reduction. Preferably, the web stiffener 32 is oriented within the hollow interior 29 so that its edge is at a right angle to the face sheet 2, as this is the position believed to provide the maximum resistance to deflection or warping of the cross member 15.

Figure 6:
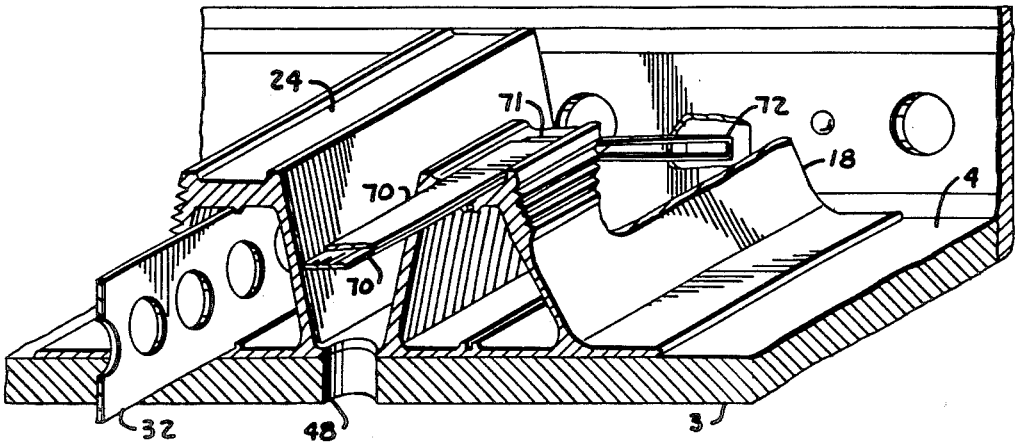
FIG. 6 is an enlarged perspective view showing an alternative form of a stiffener within the form cross member.
Figure 7:
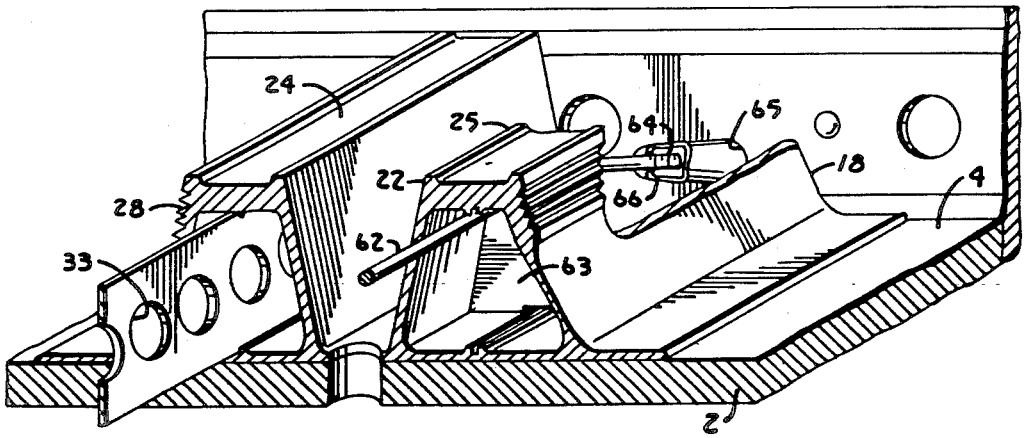
FIG. 7 is an enlarged, fragmentary elevational view showing yet another alternative form of stiffener within the form cross member.

Alternative forms of internal stiffeners may be employed within the hollow ribs 18 and 19, and are shown in FIGS. 5 and 6. In FIG. 5, the internal stiffener is in the form of a rod 62, such as steel rod, bent over rib internal supports 63 and with the rod ends 64 extended through holes 65 through the side rails 12 aligned with the hollow interior of the rib 18 or 19. A rod anchor 66 in the form of a conical nut insertable into the hole 65 screws on the rod end 64 and tensions the rod 62 between the spaced side rails 12 and over the supports 63 to press against the face sheet 2 and resist deflection.

Another form of internal stiffener may be a strap 70, FIG. 6, which is routed through slots 71 in the rib top strip 24 and slots 72 through the side rail 12 positioned adjacent the face sheet 2 and aligned with the hollow interior of the rib 18 and 19. Preferably, the strap 70 is a pre-tensioned steel strap with ends secured together by conventional means.

Other forms of internal stiffeners may be employed to provide additional resistance to deflection of the cross member 15. The material used therefor may be a different material, such as steel, than the material of the cross members, which is preferably aluminum.

The stronger elements are utilized in larger form pieces, resulting in a panel of equal capacity as the smaller pieces, which if not stregthened, would limit the capacity of the entire system when used together.

As shown in FIGS. 1, 2 and 3, the cross members 15 are secured to the form panel 1 transversely or crosswardly of the side rails 12 by welding or other appropriate fastening means.

To connect the form panels 1 together, the side rails 12 have a series of holes 35 therethrough for connection of fasteners extending between the form panels 1. Preferably, the holes 35 are backed by reinforcing plates 36 riveted or otherwise secured to the side rail 12, FIG. 4. Placement of the holes 35 is particularly important for proper rigidity of the form panel 1 and in the illustrated example, the holes 35 include certain holes 38 located through the side rail 12 between the cross members 15 and other holes 39 positioned through the side rail 12 and aligned between the ribs 18 and 19 of each cross member 15. Fastening locations between the ribs 18 and 19 and medially of the base strip 17 provide effective dispersion of any otherwise deforming stress localized at the side rail 12 to spread the stress directly to the cross members 15.

Suitable means for effecting fastening include the commonly used bolts or pins and in the illustrated example, pins 42 are employed and are in the form of headed pins with end slots for accepting a wedge 43 to pull the pin 42 snug and tightly connect adjacent side rails 12. Corner forms 45, FIG. 3, are used for ninety degree orientation and are in the form of extruded angle members.

Apertures 48, FIGS. 4 and 5, extend through the form panel 1 for receiving wall ties 50. The wall ties 50 may be in the form of wire ties as shown, FIG. 5, or flat strip stock commonly known as flat wall ties, and the configuration of the apertures 48 is selected for either wire or flat wall ties. In the illustrated example, FIG. 5, the round or wire form tie is used and, therefor, the aperture 48 is circular. The aperture 48 extends through the face sheet 2, and through the base strips 17 to emerge between the ribs 18 and 19. In the illustrated example, FIGS. 1, 2 and 3, the wall tie apertures 48 are positioned medially on the form panels 1 for maximum dispersion of deflection inducing force. As shown in FIG. 1, the form panels 1 are mounted together through a combination of pins 42 extending through the side rails 12 and wall ties 50 extending through the face sheet 2 to effectively distribute and disperse spreading force on the forms. The placement of the wall tie aperture 48 relative to the side rail 12 is foreshortened in FIG. 4 for purposes of illustration. Wall tie apertures 48 and the accompanying wall ties 50 can be extended through the connecting web base strip 17 at any location therealong. The apertures 48 may be formed by the manufacturer or may be drilled at the worksite to accommodate the field situation. This is particularly advantageous when constructing column forms, FIG. 3. When used as a column form, as stated below, the side rails 12 of a neighboring form would be perpendicularly connected to the face sheet 2 of its neighbor.

The connecting web strip 17 may be located adjacent the face sheet 2 or spaced outwardly of the face sheet. In either location, the strip 17 acts as a load bearing and distribution surface for stress from the side rail pins 42 or wall ties 50.

In the illustrated example, fastening means are employed for the wall tie ends and which engage the outer surface of the adjacent stiffener ribs 18 and 19 for maximum dispersal of stress. As shown in FIG. 5, this includes a wedge 52 having a hole and slot arrangement 53 for receiving the enlarged head of the wall tie 50 and a flat lower surface 54 for riding on the strips 25 at the margins of the legs 22 and 23. The wedge 52 is normally driven into place by hammering.

As afore stated, the wall ties 50 are used to connect parallel, spaced, form panels 1 together, as shown in FIG. 1 and 2. The wall tie apertures 48 may also be used in connecting form panels 1 together at right angles, FIG. 3. In this case, pins 42 extend through the side rail holes 38 and 39 and through the apertures 48, and are secured by the wedge 43. A flat plate 56 fits over the top of the ribs 18 and 19 for bearing against the wedge 43.

In the use of the concrete form panel 1, adjoining panels 1 may be formed in a line, connected together, and faced by parallel, spaced, other form panels 1 for construction of a wall, as in foundation or above grade construction. Referring to FIG. 1, the pins 42 and wedges 43 are used to connect the side rails 12 of adjacent form panels 1 together, as in normal construction. As shown in FIG. 1, the spaced, parallel form panels on opposite sides of the wall may be joined together at the side rails 12 by wall ties extending therebetween. Two forms of the wall ties 50 are shown including a flat or strip tie 58 and a end loop wire tie 59. Both of these ties are designed to be mounted between the side rails 12 in indentations in the side rail and held in position by the pins 42 extending between adjacent side rails. To also secure the face to face panels 1 together at positions other than the side rails 12, the wall tie apertures 48 are employed to position wall ties 50 between the forms at positions approximately midway or medially between the side rails 12. This ability is particularly advantageous when stacked form panels are used; that is, panels positioned on top of each other so that substantial downward and outward thrust accumulates at the bottom of the forms.

In FIG. 2 is disclosed the use of the form panel 1 in construction of an in-fill column, as commonly used in concrete block, or cinder blocks, building construction. In this application, form panels 1 are positioned on either side of the cinder block wall and are positioned over the area for the in-fill column. Previously this was accomplished by erecting plywood panels on either side of the column area and extending wall ties between the plywood panels. In the illustrated example, the form panels 1 include medially positioned wall tie apertures 48 whereby the form panels 1 are connected by the wall ties 50 extending through the apertures 48 to sandwich the cinder block wall and blank column area therebetween in preparation for pouring.

Referring to FIG. 3, the form panels 1 may be used to create a form for a free standing column. The form panels 1 may be arranged in a square or rectangle by abutment of the side rails 12 together through connection of right angle corner forms, or one of the panels may be moved inwardly, as shown in FIG. 3, so that its side rails 12 connect to the form tie apertures 48 through the use of pins 42. Substantial downward force may be encountered in a column pour situation and for this reason, form ties are extended between unused and colinearly aligned form tie apertures 48 on confronting form panels. Thus, the combination of side rail pins 42 and wall ties 50 between the panels acts to keep the column form from bursting or spreading at its base during pouring operations.

An alternative form of frame work 10 is depicted in FIGS. 8 and 9 and is characterized by rail stiffener strips 75 secured to the frame rails, such as the side rails 12, for added rigidity and resistance to deflection. In this embodiment, the stiffener strips 75 are preferably of a material dissimilar to the material of the side rail 12 to add greater strength thereto. For example, the frame work 10 may be composed of an aluminum alloy which is lightweight and relatively strong, but has a certain deflection under loading. The stiffener strips 75 may be of steel, which can be inexpensively maintained, but weigh more than the aluminum. The use of steel stiffener strips provides a manufacturing advantage in maintaining low cost while achieving a desired increase in strength. For example, the strips 75 may be of readily available coiled strip steel stock.

As shown in FIGS. 8 and 9, the rails 12 include a central indented portion 77 and spaced ribs 78 and 79 on an outer surface 80 facing away from the face sheet 2. An inner surface 81 is located to the interior of the frame work 10 and faces the face sheet 2. When the panels 1 are joined together side by side, the ribs 78 of adjoining side rails 12 engage and prevent flashing of the concrete.

The rail stiffener strips 75 are positioned on alternate opposite surfaces 80 and 81 of the rail 12 and have spaced ends 83 overlapping, FIG. 8. The stiffener strips 75 are positioned on the rail outer surface 80 opposite of the cross members 15 and mounted between the ribs 78 and 79, and are positioned on the rail inner surface 81 between the cross members 15.

As aforementioned, the stiffener strips 75 are of a length so that the strip ends 83 overlap on opposite surfaces of the side rail 12. At least the stiffener strips 75 mounted on the inner surface 81 have angled corners 84 for an interference free fit adjacent the cross members 15.

The stiffener strips 75 are secured to the side rail 12 by fasteners, such as rivets. Preferably, the number and type of rivet is selected so that the stiffener strip cannot rotate relative to the side rail 12 upon the application of deflecting forces to the side rail. For example, the fastener may be a single square shank rivet 86 which has a non-circular shank, in cross section, to prevent relative rotation for maximum stiffness. Alternatively, there may be two standard rivets 87 emplaced at each end.

The alternating, continuous arrangement of the stiffener strips 75 relative to the rails 12 provides continuity for increased strength of the rail, accommodates the cross members 15, and provides superior resistance to deflection than, for example, a single reinforcing strip, or doubler, located only along the rail outer surface 80. The location of the reinforcing strip in different, parallel planes of the side rail 12 provides optimum resistance to load both parallel and perpendicular to the longitudinal axis of the rail.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A set of concrete form panels each comprising:
(a) a face sheet having front and back surfaces, top and bottom end edges and spaced side edges;
(b) rails affixed to said face sheet at said edges, projecting rearwardly and having inner and outer surfaces;
(c) a plurality of cross members mounted against said face sheet and extending between said rails to provide rigidity to said panel;
(d) a plurality of rail stiffener strips alternating on opposite surfaces of said rails and secured to said outer surfaces opposite said cross members, to said inner surfaces between said cross members, and with ends overlapping on opposite said inner and outer surfaces; and
(e) bores through said rails for inserting connecting means to join said panels together side by side.

2. The concrete form panels set forth in claim 1 including:
(a) fasteners extending through said rails at intervals therealong and extending through the ends of said stiffener strips on opposite surfaces of said rail.

3. The concrete form panel set forth in claim 2 wherein:
(a) said fasteners have of non-circular transverse cross section shafts to secure said stiffener strips about said rails.

4. The concrete form panel set forth in claim 2 wherein:
(a) there are two said fasteners at each end of said stiffener strips for non-rotatably securing said stiffener strips to said rails.

5. The concrete form panel set forth in claim 1 wherein:
(a) said stiffener strips are of a dissimilar material to said rails.

6. A set of concrete form panels each comprising:
(a) a face sheet having front and back surfaces, top and bottom end edges and spaced side edges;
(b) side rails and top rails affixed to said face sheet respectively at said side edges and end edges, projecting rearwardly and having inner and outer surfaces;
(c) a plurality of cross members mounted against said face sheet and extending between said side rails for providing rigidity to said panel;
(d) each of said cross members including spaced, parallel, hollow ribs with a web extending between and enclosing said ribs;
(e) a plurality of rail stiffener strips alternating on opposite surfaces of said side rails and secured by fasteners to said outer surfaces opposite said cross members, to said inner surfaces between said cross members, and with ends overlapping on opposite said inner and outer surfaces, said rail stiffener strips being of a dissimilar material to said side rails and adding rigidity thereto; and
(f) bores through said side rails for inserting connecting means to join said panels together side by side.

* * * * *